US010222747B2

(12) United States Patent
Christan et al.

(10) Patent No.: US 10,222,747 B2
(45) Date of Patent: Mar. 5, 2019

(54) BALANCE SPRING STUD-HOLDER WITH SIMPLIED ASSEMBLY

(71) Applicant: ETA SA Manufacture Horlogere Suisse, Grenchen (CH)

(72) Inventors: Julien Christan, Bienne (CH); Patrick Moller, Flumenthal (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 15/339,322

(22) Filed: Oct. 31, 2016

(65) Prior Publication Data

US 2017/0168456 A1 Jun. 15, 2017

(30) Foreign Application Priority Data

Dec. 11, 2015 (EP) ..... 15199633

(51) Int. Cl.
*G04D 1/04* (2006.01)
*G04B 17/32* (2006.01)
*G04B 18/06* (2006.01)

(52) U.S. Cl.
CPC ..... *G04B 17/32* (2013.01); *G04B 17/325* (2013.01); *G04B 18/06* (2013.01); *G04D 1/04* (2013.01); *G04D 1/048* (2013.01)

(58) Field of Classification Search
CPC .... G04B 17/32; G04B 17/325; G04B 29/025; G04B 18/06; G04D 1/04; G04D 1/042; G04D 1/044; G04D 1/045; G04D 1/048
See application file for complete search history.

(56) References Cited

U.S. PATENT DOCUMENTS 2,997,841 A * 8/1961 Loge ..... G04B 17/325 368/175
3,046,725 A * 7/1962 Vuilleumier ..... G04B 18/06 368/178

(Continued)

FOREIGN PATENT DOCUMENTS

CH 705 440 A2 3/2013
EP 2 304 055 A1 11/2014

OTHER PUBLICATIONS

Rochat, Jean-Philippe, English Translation of CH 705440, originally published Mar. 15, 2015, retrieved on Apr. 30, 2018 from Espacenet, full document.*

(Continued)

*Primary Examiner* — Daniel P Wicklund
(74) *Attorney, Agent, or Firm* — Oblon, McClelland, Maier & Neustadt, L.L.P.

(57) ABSTRACT

An assembly for holding or supporting a timepiece balance spring, including a balance spring stud and a stud-holder, wherein the stud-holder includes a base having at least one circular portion, the base including, on the circular portion, a first lug and a second lug each extending radially; one of the two lugs including an elastic arm extending from the lug, in a direction parallel to that of the base, towards the other lug, the elastic arm forming with the base a housing for housing the balance spring stud therein and in that the first and second lugs are able to cooperate with a tool to allow the balance spring stud to exert a stress on the elastic arm to deform the latter and permit the assembly or disassembly of the stud.

15 Claims, 3 Drawing Sheets

(56) References Cited

U.S. PATENT DOCUMENTS

| | | | | | |
|---|---|---|---|---|---|
| 3,154,912 | A * | 11/1964 | Pinkas | G04B 17/325 | 368/170 |
| 3,186,160 | A * | 6/1965 | Dickerman | G04B 18/023 | 368/174 |
| 3,241,307 | A * | 3/1966 | Dickerman | G04B 18/023 | 368/170 |
| 3,262,261 | A * | 7/1966 | Monnin | G04B 17/325 | 368/178 |
| 3,842,592 | A * | 10/1974 | Giger | G04B 17/325 | 368/178 |
| 5,907,524 | A | 5/1999 | Marmy et al. | | |
| 2005/0073912 | A1* | 4/2005 | Geyer | G04B 18/02 | 368/127 |
| 2006/0062088 | A1* | 3/2006 | Hintze | G04B 18/023 | 368/175 |
| 2007/0091729 | A1* | 4/2007 | Takahashi | G04B 17/06 | 368/170 |
| 2014/0341001 | A1 | 11/2014 | Cordier | | |
| 2015/0138934 | A1* | 5/2015 | Courvoisier | G04B 18/06 | 368/178 |
| 2016/0154379 | A1* | 6/2016 | Bertrand | G04B 17/063 | 368/127 |

OTHER PUBLICATIONS

European Search Report dated Apr. 19, 2016 in European Application 15199633.7 filed on Dec. 11, 2015 (with Written Opinion and English Translation of Categories of Cited Documents).

* cited by examiner

BALANCE SPRING STUD-HOLDER WITH SIMPLIED ASSEMBLY

This application claims priority from European Patent Application No 15199633.7 of Dec. 11, 2015, the entire disclosure of which is hereby incorporated herein by reference.

The present invention concerns an assembly for holding or supporting a timepiece balance spring including a balance spring stud and a stud-holder.

PRIOR ART

In a mechanical watch, it is usual to use a regulating member comprising a sprung-balance device. Conventionally, the inner end of the balance spring is attached to a collet provided on the balance staff. In order to attach and position the inner end of the balance spring, it is known to use a stud-holder housing a balance spring stud, in association with a clamping screw to clamp the stud against the portion of the balance spring engaged in the stud-holder.

In such an assembly, the stud-holder is conventionally attached to a balance-cock also used for attaching one of the ends of the balance staff. The balance-cock is devised to incorporate a setting equipped with a shock-absorber device for the balance staff. A known stud-holder uses two rings. These two rings are mounted to be movable in rotation at the setting. Each ring comprises an extension in the shape of a tuning fork or a Y, the Y-shaped fork thus forming a housing.

A first ring is then used for housing the stud whereas the second ring is used for housing an adjustment element. This adjustment element makes it possible to adjust the limitation of the balance spring to adjust the rate and therefore the frequency of the balance spring.

Although such a device has proved effective for the steel balance springs currently used, it is considerably less practical for the use of the latest generation of silicon springs. Indeed, these materials have the reputation of being quite fragile. However, the current stud-holder requires a great deal of handling during assembly and after-sales service so that the risk of damaging silicon balance springs is considerable.

SUMMARY OF THE INVENTION

It is an object of the invention to overcome the drawbacks of the prior art by proposing to provide an assembly for holding or supporting a timepiece balance spring which allows simplified assembly or disassembly of the balance spring stud.

To this end, the present invention concerns an assembly for holding or supporting a timepiece balance spring, comprising a balance spring stud and a stud-holder, characterized in that said stud-holder comprises a base having at least one circular portion, said base comprising, on said circular portion, a first plot and a second plot each extending radially; one of the two lugs comprising an elastic arm extending from the lug, in a direction parallel to that of the base, towards the other lug, said elastic arm forming with said base a housing for housing the balance spring stud and in that said first and second lugs are able to cooperate with a tool to allow the balance spring stud to exert a stress on the elastic arm to deform the latter and permit the assembly or disassembly of said stud.

This holding assembly according to the invention thus allows for simple assembly/disassembly of the balance spring stud which minimises stresses on the balance spring.

In a first advantageous embodiment, said stud-holder further comprises a notch arranged such that the balance spring stud can be housed therein.

In a second advantageous embodiment, the notch is arranged on the base.

In a third advantageous embodiment, the notch is arranged on the elastic arm.

In a fourth advantageous embodiment, the first lug and the second lug are angularly separated by an angle of less than 180 degrees.

The invention further concerns a method for assembly of a balance spring stud on a stud-holder, said stud-holder comprising a base having at least one circular portion attached to a balance-cock, said base comprising, on said circular portion, a first lug and a second lug each extending radially; the first lug comprising an elastic arm extending from its end, in a direction parallel to that of the base, towards the second lug, said elastic arm forming with said base a housing for housing the balance spring stud, said method comprising the following steps:

- taking a tool capable of performing a pinching action with two arms;
- placing the balance spring stud at the entrance to the housing;
- operating said tool so that one arm of the tool rests on the first lug provided with the elastic arm and so that the other arm of the tool rests on the balance spring stud, said tool being operated such that said first lug and said balance spring stud prevent said arms moving closer together;
- exerting a force on the arms of the tool intended to move them closer together so that the balance spring stud exerts a force on the elastic arm, the force exerted by the arms of the tool is increased so that the force exerted by the balance spring stud on the elastic arm causes a deformation thereof allowing said balance spring stud to be inserted inside the housing.

In a variant, the assembly method includes the following steps:

- taking a first tool capable of performing a pinching action with two arms, and a second tool;
- placing the balance spring stud at the entrance to the housing while holding it via the first tool;

In a first advantageous embodiment, said stud-holder further comprises a notch arranged such that the balance spring stud can be housed therein.

The invention also concerns a method for disassembly of a balance spring stud from a stud-holder, said stud-holder comprising a base having at least one circular portion attached to a balance-cock, said base comprising, on said circular portion, a first lug and a second lug each extending radially; one of the two lugs comprising an elastic arm extending from the lug, in a direction parallel to that of the base, towards the other lug, said elastic arm forming with said base a housing for housing the balance spring stud, said method comprising the following steps:

- taking a tool capable of performing a pinching action with two arms;
- operating said tool so that one arm of the tool rests on the second lug and so that the other arm of the tool rests on the balance spring stud, said tool being operated such that said second lug and said balance spring stud prevent said arms moving closer together;
- exerting a force on the arms of the tool intended to move them closer together so that the balance spring stud exerts a force on the elastic arm, the force exerted by the arms of the tool is increased so that the force exerted by the balance spring stud on the elastic arm causes a deformation thereof allowing said balance spring stud to leave the housing.

In a variant, the method includes the following steps:

taking a first tool capable of performing a pinching action with two arms, and a second tool;

placing the balance spring stud at the entrance to the housing while holding it via the first tool;

operating said second tool to lever and deform the elastic arm, allowing the housing to become wider to remove said balance spring stud.

In a first advantageous embodiment, said stud-holder also includes a notch arranged such that the balance spring stud can be housed therein, the force exerted by the arms of said tool and transmitted to the elastic arm via the stud is sufficient to remove the stud from the notch.

BRIEF DESCRIPTION OF THE DRAWINGS

The objects, advantages and features of the invention will appear more clearly in the following detailed description of at least one embodiment of the invention, given solely by way of non-limiting example and illustrated by the annexed drawings, in which.

DETAILED DESCRIPTION

The present invention proceeds from the general idea of providing an assembly for holding or supporting a timepiece balance spring permitting simpler assembly/disassembly of the balance spring stud.

Figure 1:
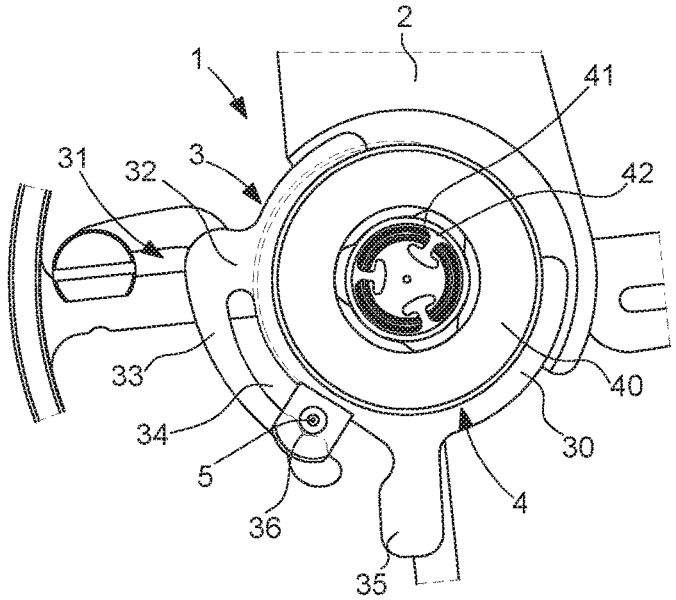
FIGS. 1 and 2 show a diagram of a holding assembly according to the invention.

FIG. 1 shows the holding or support assembly 1 according to the present invention. This assembly 1 is mounted on a balance cock 2 and comprises a balance spring stud holder 3 used for holding balance spring stud 5. Balance-cock 2 is made to include a pivot device 4, this pivot device 4 may take the form of a bearing body 40 in which is arranged a setting 41 provided with a pierced jewel 42 and endstone 43 and a spring 44.

Figure 2:
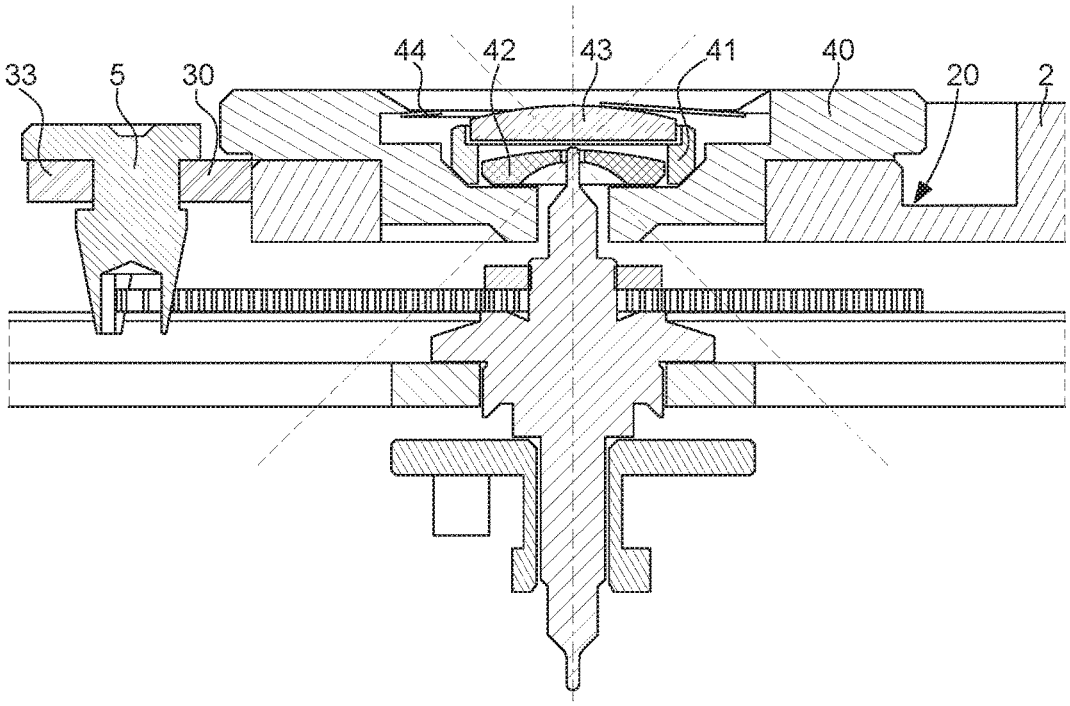

Stud-holder 3 according to the invention comprises a base 30. This base 30 takes the form of an open ring or at least a part having at least one circular portion. This base 30 is attached to balance cock 2. A first possibility consists in giving a structure to balance-cock 2, for example by hollowing it out partly to form a chimney 20 on which the bearing body is mounted. This chimney is the element of the balance-cock that will be used for attaching base 30. Consequently, the chimney is structured to have a circular shape as seen in FIG. 2. According to a second possibility, the dimensions of base 30 enable it to be attached to bearing body 40 of the shock absorber system. The annular shape of base 30 allows it to move in rotation. Base 30 can then be snap fitted around bearing body 40. Of course, this pivot device 4 may simply be a cylindrical, protruding portion including a shock absorber device or simply a hole for the pivot arbor.

Base 30 comprises means of attachment 31 for the attachment of balance spring stud 5. These attachment means 31 ingeniously comprise a first lug 32, this first lug 32 extends radially from base 30. The end of the lug is completed by an arm 33. Arm 33 is integral with lug 32 and extends, from the end of said lug 31, parallel to the curvature of base 30. Arm 33 is preferably elastic and is used for attaching the balance spring stud.

Elastic arm 33 and base 30 thus form a housing 34 into which balance spring stud 5 can be inserted.

Ingeniously according to the invention, it is provided that the assembly of the balance spring stud is simplified. To this end, base 30 is provided with a second lug 35. Second lug 35 also extends radially from said base. Second lug 35 is arranged such that the first lug and the second lug are angularly separated by an angle of less than 180°. The angle between the lugs is determined by the length required for the arm and the space available with the balance-cock. Preferably, the angle will be less than 120°. This arrangement allows a simple stud assembly method to be used. To this end, the stud is initially mounted on the balance spring.

In a first step, the balance spring is assembled to the stud, the stud is placed at the entrance to housing 34 formed by elastic arm 33 and base 30.

In a second step, the user takes a first tool or instrument of the tweezer type. This means an instrument such as fine pincers that can be provided with a spring. Once equipped with the tweezers, the user positions one of the tweezer arms resting on the balance spring stud and the second arm resting on first lug 32. More particularly, the tweezer arms are positioned such that they are apart and such that first lug 32 and balance spring stud 5 form an obstacle preventing the arms from returning to their rest position.

Figure 3:
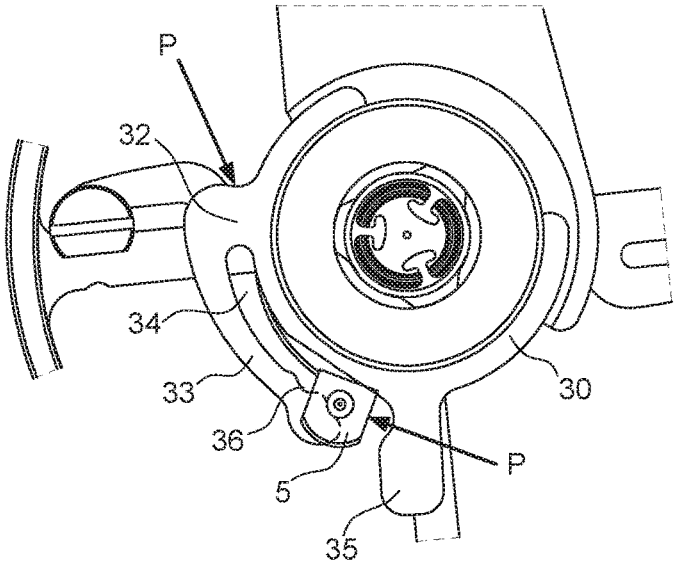
FIGS. 3 to 5 show a diagram of operations for assembly and disassembly of the balance spring stud on the holding assembly according to the invention.
Figure 4:
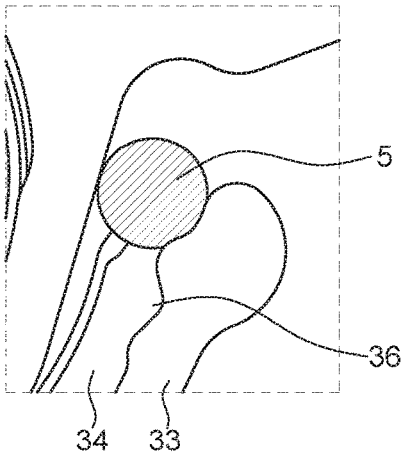

In a third step seen in FIG. 3, the user exerts a pressure P on the tweezer arms. This pressure is then transmitted to the first lug and to the stud. Given that first lug 32 is integral with the base, the pressure exerted by the arms thus causes movement of balance spring stud 5 which is the only component able to move. The stud, under the effect of the force exerted by the tweezers, tends to exert pressure on the entrance to housing 34. This pressure then causes elastic arm 33 to move aside so that the stud can be inserted into the housing. Preferably, elastic arm 33 and/or base 30 are provided with a notch 36 as seen in FIG. 4. This notch 36 is used to lock the position of the stud. Indeed, without a notch, there is a risk that the force exerted by the arm on stud 5 would not be sufficient. Consequently, a shock could cause balance spring stud 5 to slide in housing 34 and cause a malfunction of the watch regulating system. Notch 36 placed on base 30 and/or elastic arm 33 allow the number of contact points to be increased. In the absence of a notch 36, there are two contact points with the balance spring stud: a contact point between the stud and the base and a contact point between the stud and the elastic arm. Where a V-shaped notch is present, the stud is naturally placed in its optimum position and is better retained due to the higher number of contact points. The optimum number of contact points is three, a higher number would cause excessive force, which would be less beneficial, less efficient.

Figure 6:
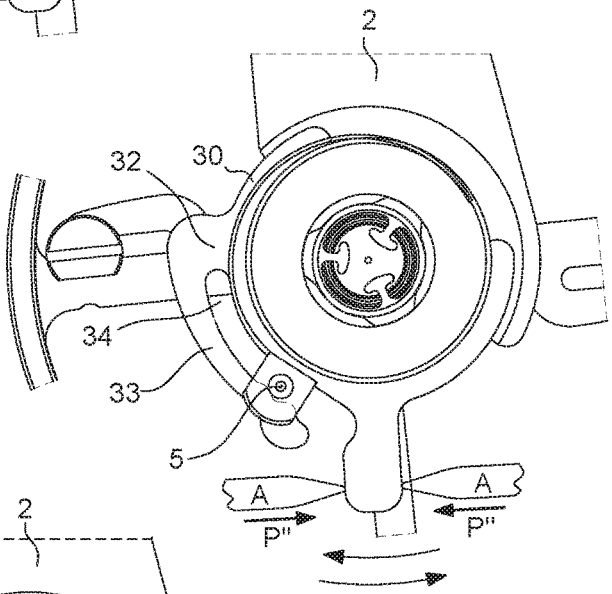
FIG. 6 shows a variant of the operation to assemble the balance spring stud of the holding assembly according to the invention.

Once the stud is in the desired position, the user removes the tweezers. He can then perform an optional angular adjustment operation. Indeed, with a base 30 having a ring shape and mounted on the setting, base 30 could be arranged to be angularly movable. This advantageously allows the angular position of stud 5 to be modified to adjust the rate of the watch. To achieve this, the user uses tweezers. He can advantageously place the tweezer arms A on either side of second lug 35 pinching it with a pressure P" or between first lug 32 and second lug 35. He can then move the ring clockwise or anticlockwise in order to modify the angular position of stud 5, as seen in FIG. 6.

These assembly and adjustment operations are advantageous since they minimise handling operations and therefore minimise the stresses applied to the balance spring. In this manner, it is possible to envisage having a balance spring made of silicon type material, deemed to be less brittle than the conventional metal balance springs.

To disengage balance spring stud 5 from stud holder 3, several procedures are possible.

A first procedure consists in using tweezers, these tweezers being one of the basic tools of a watchmaker. Once the user is equipped with the tweezers, the procedure can start.

This first procedure uses the same principle as for the engagement of stud 5 on stud holder 3. Therefore, the user moves the tweezer arms apart so that one of the arms rests on second lug 35 while the other arm rests on stud 5, as seen in FIG. 3. This arrangement of the tweezer arms is provided such that second lug 35 and stud 5 tend to prevent the tweezer arms from returning to their initial position.

Figure 5:
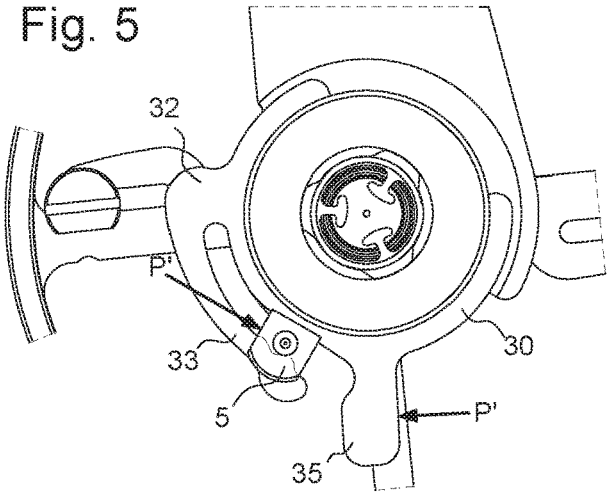

Once the tweezers are in the right position, the user exerts a pressure P' on said tweezer arms to attempt to return them to their initial position. The pressure exerted by the user is transmitted to stud 5 which, with second lug 35, is the only element adapted to be movable. Consequently, stud 5 it exerts a pressure on base 30 and on elastic arm 33. If the pressure exerted by the user increases, it may become sufficient to move aside elastic arm 33. In such case, stud 5 leaves notch 36. The user can then grasp said stud 5 with the tweezers and remove it from the housing as seen in FIG. 5. It may advantageously be arranged for second lug 35 to be provided with a notch 35', which acts as a stop for the stud, which prevents the stud from moving too far away from the balance due to the jolt, which could break the balance spring.

Figure 7:
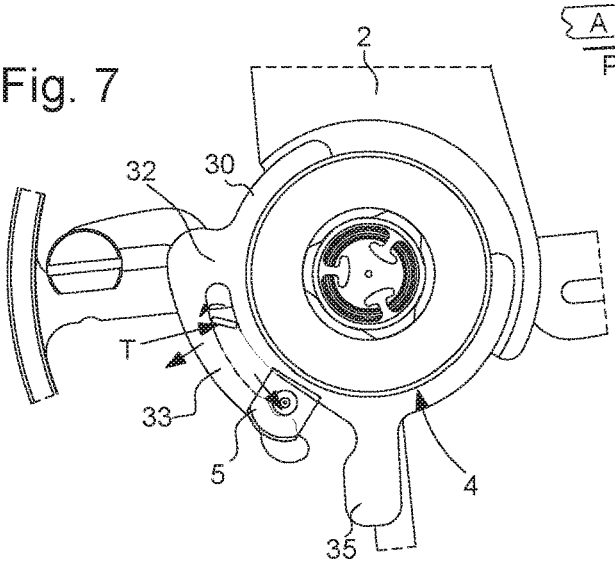
FIG. 7 shows a variant of the operation to disassemble the balance spring stud of the holding assembly according to the invention.

According to a second method for disengaging the stud seen in FIG. 7, the user must first be equipped with tweezers but also with a second tool of the screwdriver type T. Once equipped, the user uses the tweezers to grasp stud 5 and simultaneously uses the screwdriver, preferably a flat head screwdriver. Screwdriver T is used in the following manner. The screwdriver head is inserted into the housing, preferably with the flat head extending parallel to the base. The user then rotates the screwdriver on itself. This rotation allows the screwdriver to enter into contact with the base and the elastic arm. If the user continues to rotate the screwdriver, leverage occurs, as the dimensions of the screwdriver are defined to make this possible. The leverage then causes a stress to occur on elastic arm 33 and base 30. Given that elastic arm 33 is the only element able to be deformed, the leverage causes deformation of said arm. This deformation results in the enlargement of housing 34 and thus a decrease in the stress applied to the stud by the elastic arm. It thus becomes possible to remove the stud from its housing with the tweezers. Relaxing the rotation of the screwdriver allows said arm to return to its initial position.

In a variant of the invention, stud 5 may be made to have a conical shape, which allows it to be vertically engaged in the stud holder in the case of automated assembly.

It will be clear that various alterations and/or improvements and/or combinations evident to those skilled in the art may be made to the various embodiments of the invention set out above without departing from the scope of the invention defined by the annexed claims.

Thus, it will be understood that utilisation of screwdriver T may also be employed for assembly of the stud. The screwdriver head is inserted into the housing, preferably with the flat head extending parallel to the base. The user then rotates the screwdriver on itself. This rotation allows the screwdriver to enter into contact with the base and the elastic arm. If the user continues to rotate the screwdriver, leverage occurs, as the dimensions of the screwdriver are defined to make this possible. The leverage then causes a force to occur on elastic arm 33 and base 30. Given that elastic arm 33 is the only element able to be deformed, the leverage causes deformation of said arm. This deformation results in the enlargement of housing 34 and the possibility of slipping the stud into the housing.

What is claimed is:

1. A holding or support assembly for a timepiece balance spring, comprising:

a balance spring stud and a stud-holder mounted on a balance-cock, wherein said stud-holder comprises a base having at least one circular portion, said base comprising, on said circular portion, a first lug and a second lug each extending radially, one of the two lugs comprising an elastic arm extending from the one of the two lugs, in a direction parallel to said circular portion of said base, toward the other lug, the elastic arm forming with said circular portion of said base a housing to house the balance spring stud, and said first and second lugs are cooperable with a tool so that the balance spring stud is to exert a stress on the elastic arm to deform the elastic arm and permit assembly or disassembly of said stud-holder and the balance spring stud.

2. The holding or support assembly according to claim 1, wherein said stud-holder further comprises a notch on the elastic arm to house the balance spring stud between said circular portion of said base and the elastic arm.

3. The holding or support assembly according to claim 1, wherein said first lug and second lug are angularly separated by an angle of less than 180 degrees.

4. A holding or support assembly for a timepiece balance spring, comprising:

a balance spring stud and a stud-holder mounted on a balance-cock, wherein said stud-holder comprises a base having at least one circular portion, said base comprising, on said circular portion, a first lug and a second lug each extending radially, one of the two lugs comprising an elastic arm extending from the one of the two lugs, in a direction parallel to said circular portion of said base, toward the other lug, the elastic arm forming with said circular portion of said base a housing to house the balance spring stud, and said first and second lugs are cooperable with a tool to deform the elastic arm to permit assembly or disassembly of said stud in the housing.

5. The holding or support assembly according to claim 4, wherein said stud-holder further comprises a notch on the elastic arm to house the balance spring between said circular portion of said base and the elastic arm.

6. The holding or support assembly according to claim 4, where in said stud-holder is in contact with said notch of the elastic arm and said base through three contact points.

7. The holding or support assembly according to claim 6, wherein the three contact points are angularly separated by an angle of less than 120 degrees.

8. A method for assembly of a balance spring stud on a stud-holder, said stud-holder comprising a base having at least one circular portion attached to a balance-cock, said base comprising, on said circular portion, a first lug and a second lug each extending radially, said first lug comprising an elastic arm extending from an end of the first lug, in a direction parallel to said circular portion of said base, toward said second lug, the elastic arm forming with said circular portion of said base a housing to house the balance spring stud, said method comprising:

using a tool comprising two arms to perform a pinching action;

placing the balance spring stud at an entrance to the housing;

operating said tool so that one of the two arms of said tool rests on said first lug provided with the elastic arm and so that another of the two arms of said tool rests on the balance spring stud, said tool being operated so said first lug and the balance spring stud resist a closing movement of the two arms; and exerting a force on the two arms of said tool to move them closer together so that the balance spring stud exerts a force on the elastic arm, the force exerted by the two arms of said tool is increased so that the force exerted by the balance spring stud on the elastic arm causes a deformation to the elastic arm to insert the balance spring stud inside the housing.

9. The assembly method according to claim 8, wherein said base is a ring, said stud-holder further includes a notch to house the balance spring stud between said circular portion of said base and the elastic arm.

10. The assembly method according to claim 9, wherein said stud-holder is in contact with said notch of the elastic arm and said base through three contact points.

11. The assembly method according to claim 10, wherein the three contact points are angularly separated by an angle of less than 120 degrees.

12. The assembly method according to claim 8, wherein the balance-cock further includes a pivot device of circular shape, said base being entirely circular and mounted on said pivot device, and wherein said assembly method further comprises using said tool to pinch said second lug and set said base in rotation with respect to the pivot device.

13. A method for disassembly of a balance spring stud from a stud-holder, said stud-holder comprising a base having at least one circular portion attached to a balance-cock, said base comprising, on said circular portion, a first lug and a second lug each extending radially, said the first lug comprising an elastic arm extending from an end of the first lug, in a direction parallel to said circular portion of said base, toward said second lug, the elastic arm forming with said circular portion of said base a housing to house the balance spring stud, said method comprising:

using a tool comprising two arms to perform a pinching action;

operating said tool so that one of the two arms of said tool rests on said second lug and so that another of the two arms of said tool rests on the balance spring stud, said tool being operated so said second lug and the balance spring stud resist a closing movement of the two arms; and exerting a force on the two arms of said tool to move them closer together so that the balance spring stud exerts a stress on the elastic arm, the force exerted by the two arms of said tool is increased so that the stress exerted by the balance spring stud on the elastic arm causes a deformation to the elastic arm to move the balance spring stud to leave the housing.

14. The disassembly method according to claim 13, wherein said stud-holder also includes a notch to house the balance spring stud between said circular portion of said base and the elastic arm, and the force exerted by the two arms of said tool and transmitted to the elastic arm via the stud is sufficient to remove the stud from the notch.

15. The disassembly method according to claim 14, wherein said stud-holder is in contact with said notch of the elastic arm and said base through three contact points.

* * * * *